US009821885B2

(12) United States Patent
Salani

(10) Patent No.: US 9,821,885 B2
(45) Date of Patent: Nov. 21, 2017

(54) MULTIHULL WATERCRAFT

(71) Applicant: Steven John Salani, El Segundo, CA (US)

(72) Inventor: Steven John Salani, El Segundo, CA (US)

( * ) Notice: Subject to any disclaimer, the term of this patent is extended or adjusted under 35 U.S.C. 154(b) by 0 days.

(21) Appl. No.: 14/752,673

(22) Filed: Jun. 26, 2015

(65) Prior Publication Data

US 2016/0375971 A1 Dec. 29, 2016

(51) Int. Cl.

| | |
|---|---|
| ***B63B 1/10*** | (2006.01) |
| ***B63B 1/12*** | (2006.01) |
| ***B63H 9/08*** | (2006.01) |
| ***B63B 23/02*** | (2006.01) |
| ***B63B 27/36*** | (2006.01) |
| ***B63B 29/00*** | (2006.01) |
| ***B63H 9/10*** | (2006.01) |
| *B63B 35/00* | (2006.01) |
| *B63B 15/00* | (2006.01) |

(52) U.S. Cl.

CPC ..... *B63B 1/121* (2013.01); *B63B 1/10* (2013.01); *B63B 23/02* (2013.01); *B63B 27/36* (2013.01); *B63B 29/00* (2013.01); *B63H 9/08* (2013.01); *B63H 9/1021* (2013.01); *B63B 15/0083* (2013.01); *B63B 2035/004* (2013.01); *B63B 2035/009* (2013.01); *B63H 2009/088* (2013.01)

(58) Field of Classification Search

CPC ..... B63B 1/10; B63B 1/12–2001/128; B63B 23/00; B63B 23/02; B63B 23/04; B63B 23/06; B63B 23/08; B63B 23/10; B63B 23/12; B63B 23/14; B63B 23/16; B63B 29/00; B63B 29/02; B63B 35/44; B63B 2035/004; B63B 2035/4426; B63B 2001/203–2001/208

USPC ..... 114/61.1–61.25

See application file for complete search history.

(56) References Cited

U.S. PATENT DOCUMENTS

| | | | | | |
|---|---|---|---|---|---|
| 3,541,987 | A * | 11/1970 | Barkley | B63B 1/14 | 114/61.16 |
| 5,433,161 | A * | 7/1995 | Loui | B63B 1/24 | 114/265 |
| 5,915,321 | A * | 6/1999 | Fountaine | B63B 1/12 | 114/61.15 |
| 5,954,008 | A * | 9/1999 | Je Cho | B63B 1/107 | 114/265 |
| 6,912,965 | B2 * | 7/2005 | Leitch | B63B 1/107 | 114/261 |

FOREIGN PATENT DOCUMENTS

| | | | | |
|---|---|---|---|---|
| DE | 3716480 | A1 * | 11/1988 | B63B 23/40 |

* cited by examiner

*Primary Examiner* — Ajay Vasudeva

(57) ABSTRACT

The patent discloses a multihull watercraft with a unique hull configuration providing numerous benefits. Passenger cabins are enclosed within a separate upper hull, which allows the accommodation space and the float hulls to be independently optimized. The new configuration also provides reduced windage, and creates additional deck space for easier boarding, recreational use, and safer access to shore craft.

5 Claims, 12 Drawing Sheets

MULTIHULL WATERCRAFT

BACKGROUND OF THE INVENTION

The modern monohull watercraft can be traced back to the hollowed log canoes used by primitive cultures around the world. The long narrow hull of these ancient boats is a very efficient shape in the water, which is an important feature for a vehicle propelled only by human or wind power. In today's world of limited resources and energy an efficient hull shape continues to be a very desirable feature. For a given displacement, a hull with high aspect ratio (the length divided by the width) is much easier to push through the water than a hull with low aspect ratio.

One big disadvantage of a narrow monohull is lateral stability. The narrow hull presents a greater risk of capsize, especially for sailboats. Making the boat wider increases the stability, but creates much more drag though the water. An alternate solution is to keep the narrow hull form, but add ballast in the form of a weighted keel. The heavy ballast adds stability, but the boat is pulled deeper into the water which increases the water displacement and again increases drag.

Early Polynesians developed a clever solution to the problem of maintaining stability in a narrow monohull. The Outrigger canoe adds a secondary hull connected to the first hull by a pair of support arms. This results in a very stable boat that still retains the more efficient narrow hull form. Modern multihull watercraft (catamarans and trimarans) incorporate this idea to achieve significantly improved performance on the water.

As the multihull form developed into the 21st century, it continued to offer many advantages over traditional monohulls, but the design still has several inherent problems. There is a conflict between accommodation space and hull form. The narrow shape of catamaran and trimaran hulls, while highly efficient when moving through the water, also create awkward interior spaces. Humans prefer accommodations with roughly square-shaped floor plans, not uncomfortable tunnel shapes that are neither convenient nor inviting for any activity except sleep. Widening the hull improves the accommodation space but seriously degrades the performance of the boat.

Conventional multihulls have a further problem of awkward boarding and disembarking. This is particularly true for large catamarans on a side dock, where the high freeboard (the distance between the deck and the water) requires a ladder or portable staircase for boarding. The high freeboard also results in high amounts of lateral windage. Compensating for this windage while under way wastes a significant amount of energy, and docking and maneuvering in a tight marina can be difficult as the wind pushes the boat off course.

Conventional multihulls have a further problem of awkward storage and deployment of a shore craft (dinghy). Storage on deck takes up valuable space and may also require a crane for deployment. Dinghy davits (typically a pair of metal arms used for both storage and deployment) are also not an optimum solution in terms of convenience and aesthetic appeal. In either case, boarding and exiting the dinghy can be awkward and dangerous because there is no suitable boarding platform.

The present invention addresses all of these problems while providing additional benefits.

SUMMARY OF THE INVENTION

Unlike conventional multihulls that use the cramped float hulls for accommodation, the present invention encloses the passenger cabins in a separate upper hull several feet above the waterline. This removes the conflict between the accommodation space and the float hull form; each can be independently optimized without compromising the other. The higher elevation improves interior ventilation, increases thermal isolation between the cabins and the water, and provides better view of the surroundings for both skipper and passengers.

There are four support structures between the upper hull and the float hulls which are designed to reduce windage from the high cross winds that can be encountered at sea. Each structure is comprised of a plurality of narrow columns that provide mechanical support while allowing lateral air flow.

In order to maximize the passenger accommodation space, the forward and aft portions of the upper hull (enclosing the private cabins) extend laterally over the left and right float hulls. The central portion (enclosing the salon, galley, and other common areas) of the main hull is narrower, extending laterally to points inboard of the longitudinal centerline of the left and right float hulls. This unique configuration creates space for deck areas on the top side of the left and right float hulls. The low freeboard of the twin float hulls allows easy boarding and disembarking to docks on either side of the boat, and safer boarding of shore craft.

Access to the upper hull is via a staircase from the deck of the left or right float hull. This eliminates the need for portable boarding stairs at the dock; passengers simply step onto the deck of the float hull, then go up the stairs into the upper hull.

The present invention offers an improved method of storing and deploying a shore craft (dinghy). When not in use, the dinghy is stored in a compartment located on the underside of the upper hull. To launch the dinghy, the compartment cover is lowered to provide access to the compartment via the adjacent float hull deck. The dinghy is moved across the deck and into the water along the outside edge of the hull where it can be easily and safely boarded. In an alternate embodiment, the dinghy may be lowered directly into the water, where it may be boarded from the inboard edge of the adjacent float hull deck.

DETAILED DESCRIPTION OF THE INVENTION

Figure 1:
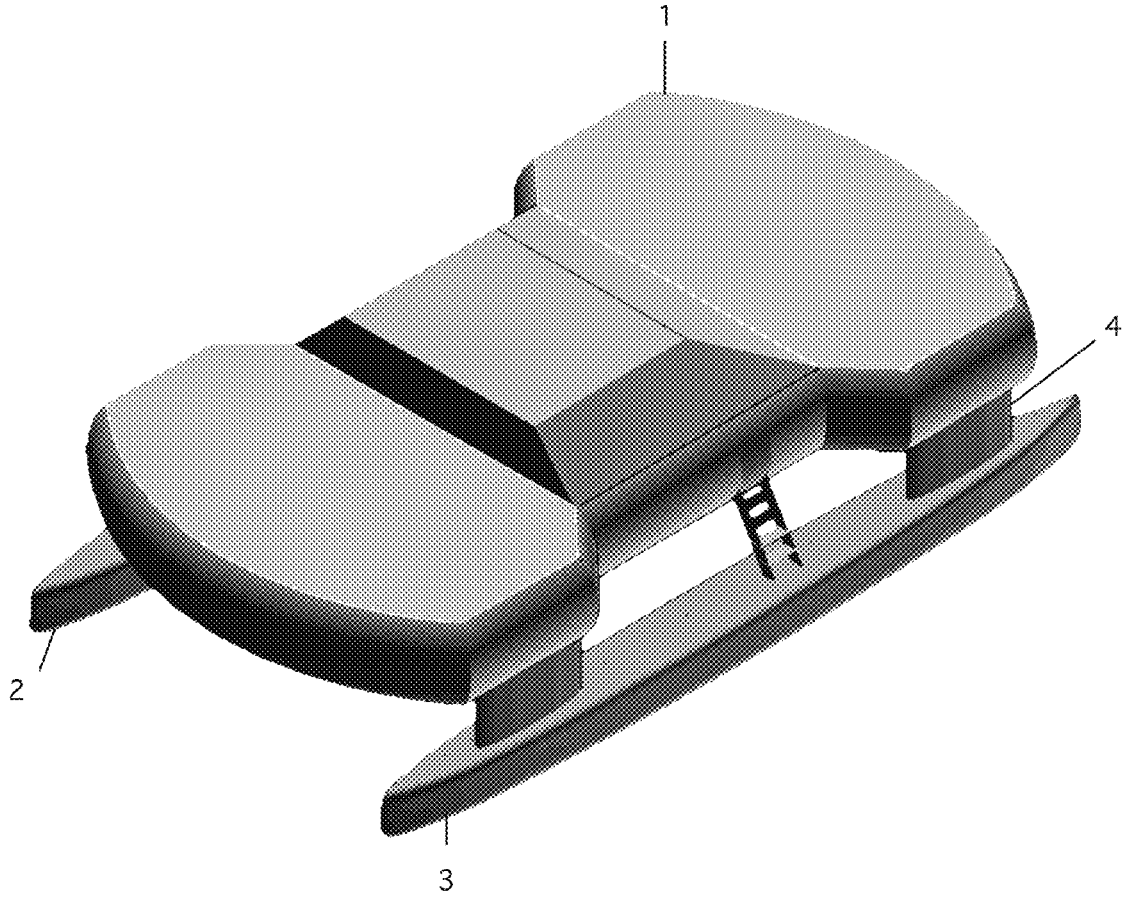
FIG. 1 is a perspective view of the multihull watercraft
Figure 2A:
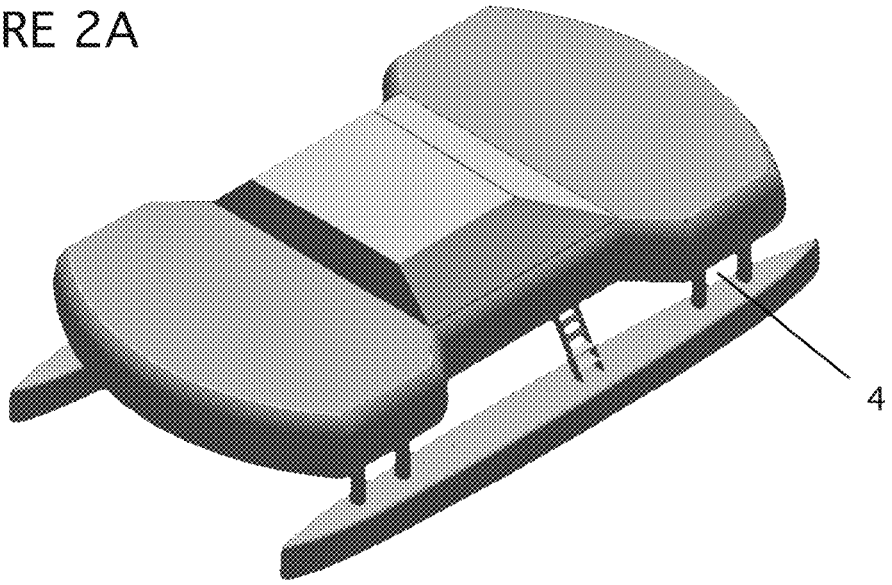
FIG. 2A is a perspective view of the multihull watercraft showing an improved embodiment of the upper hull support structures.
Figure 2B:
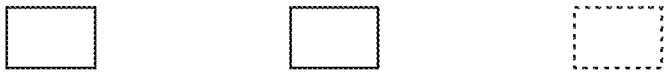
FIGS. 2B and 2C are a cross-sectional view of the improved upper hull support structures.
Figure 2C:
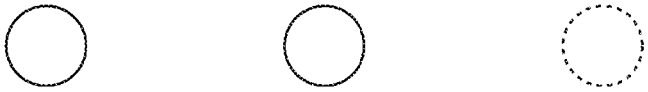

FIG. 1 illustrates an embodiment of the present invention in a powerboat configuration (without sails) however all claims of the invention are applicable to a watercraft with sails. A large upper hull 1 is suspended over a left float hull 2 and right float hull 3 by means of four support structures 4. The wide support structures shown in FIG. 1 may be improved by utilizing two or more narrow beams per support structure, which allows lateral air flow and thereby reduces lateral windage (drag). The improved support structure 4 is shown in FIG. 2A. The individual beams of said support structures may be either polygonal cross-section as shown in FIG. 2B, or cylindrical cross-section as shown in FIG. 2C.

Figure 3:
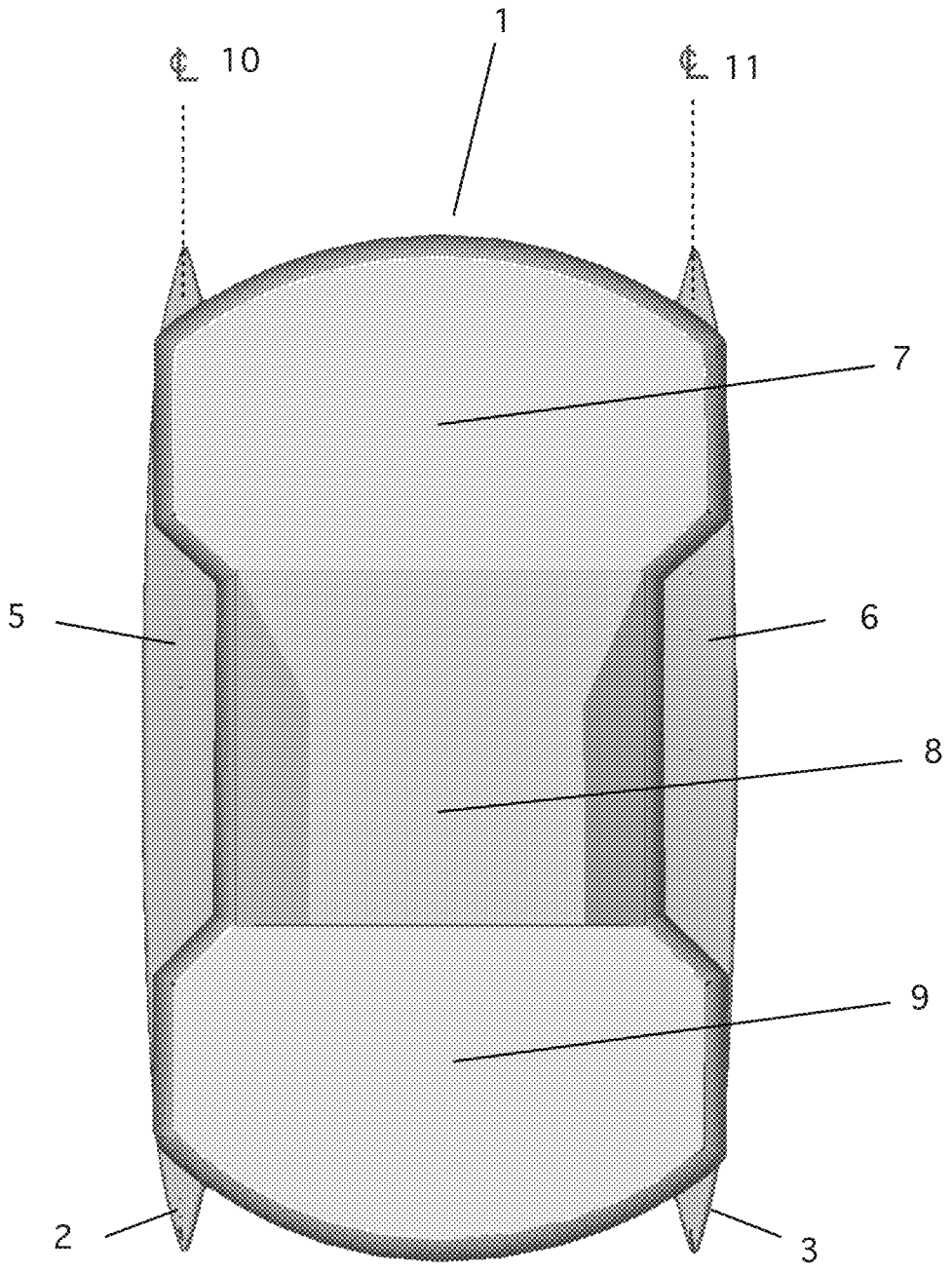
FIG. 3 is a top view of the watercraft that shows the upper hull and left and right float hulls.

The top-view diagram in FIG. 3 shows the upper hull 1 which is composed of three distinct regions. The upper hull forward portion 7 and the upper hull aft portion 9 enclose the private passenger accommodation space, and extend laterally beyond the left float hull centerline 10 and the right float hull centerline 11 to maximize the accommodation space. The upper hull middle portion 8 encloses the common areas (salon, galley, storage, etc), and is constrained to a region inboard of the left float hull centerline 10 and the right float hull centerline 11. This unique configuration creates deck areas 5 and 6 on the top of both float hulls thereby making it safer and easier to board, dock, and access shore craft. The deck areas also serve as recreation space and swim platforms.

Figure 4:
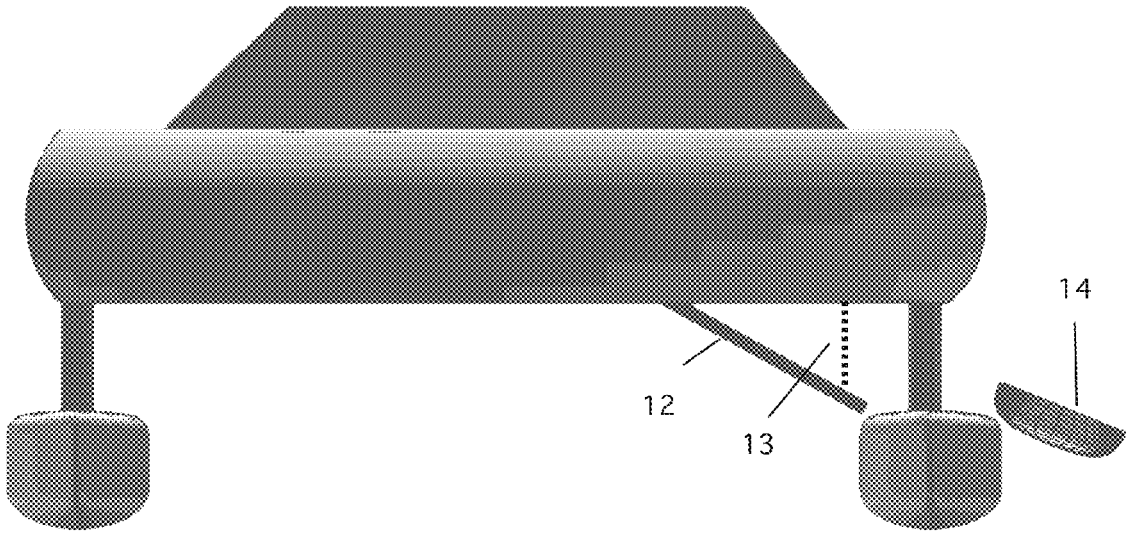
FIG. 4 is a rear view that shows the dinghy storage compartment door lowered to a position adjacent to the right float hull, whereby the dinghy can easily be moved out of the compartment, across the top side of the float hull and pushed into the water for boarding. The compartment door is illustrated as being hinged on the inboard side, however an alternative embodiment could lower the entire door (and dinghy) to an altitude matching the float hull deck.
Figure 5:
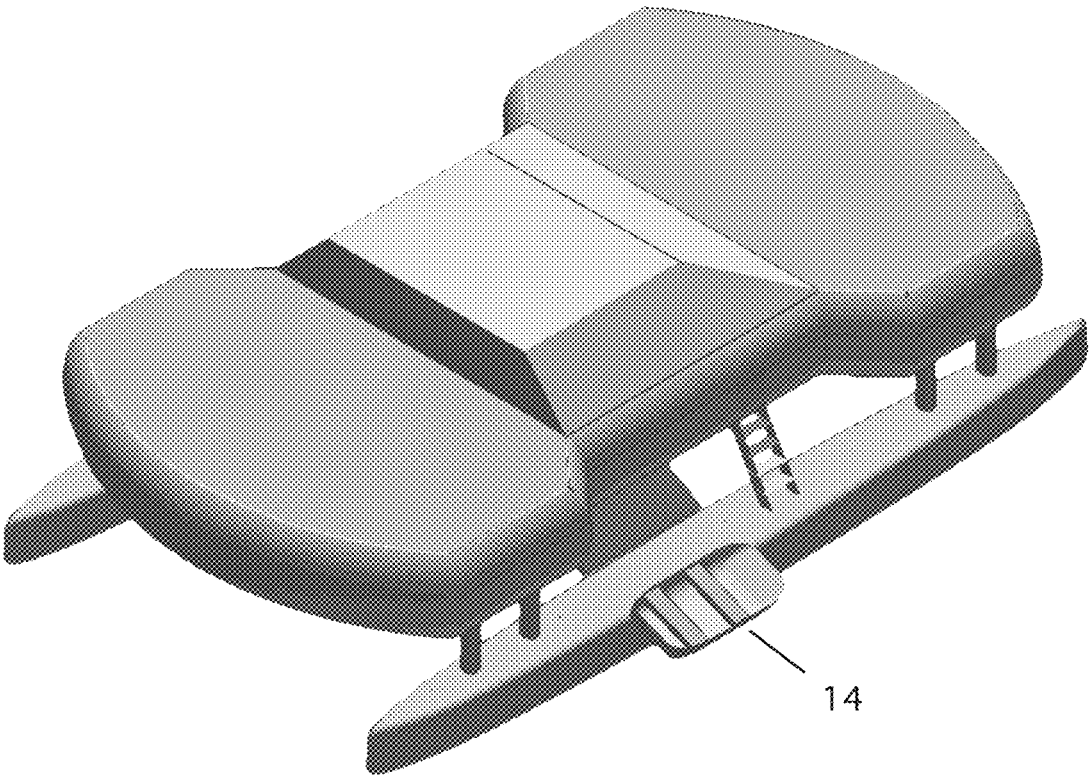
FIG. 5 is a perspective view depicting the deployment of a dinghy across the float hull and into the water where it may be boarded

FIG. 4 shows the preferred embodiment of the shore craft storage and deployment means which includes a dinghy storage compartment door 12 which can be lowered to provide access to the dinghy 14. The compartment door is opened by a lowering mechanism 13 attached to the door. FIG. 5 is a perspective view showing how the dinghy 14 can be moved out of the storage compartment, and across the adjacent deck and into the water.

Figure 6:
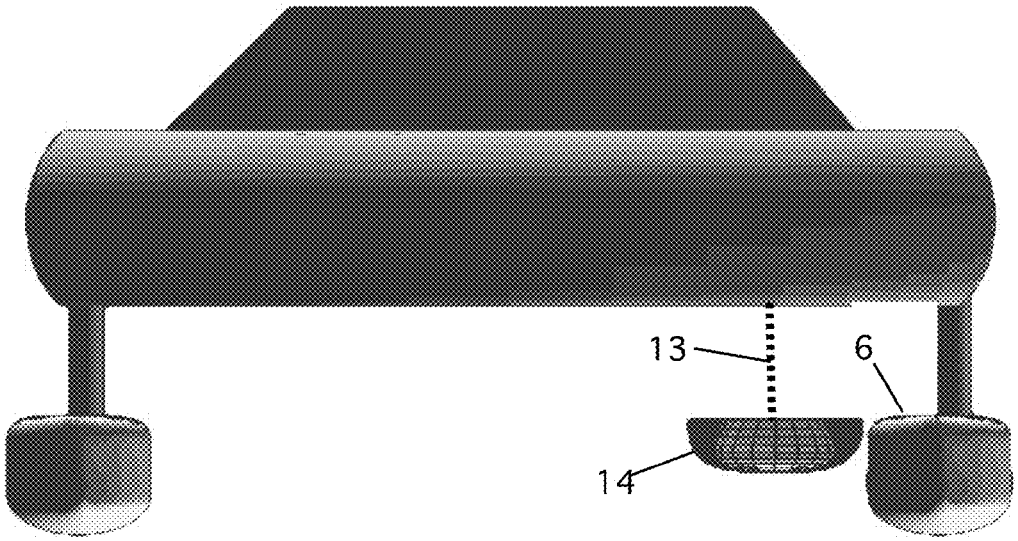
FIG. 6 is a perspective view showing an alternate embodiment wherein the dinghy is lowered from the under-hull storage compartment directly into the water for boarding via the deck of the adjacent float hull.
Figure 7:
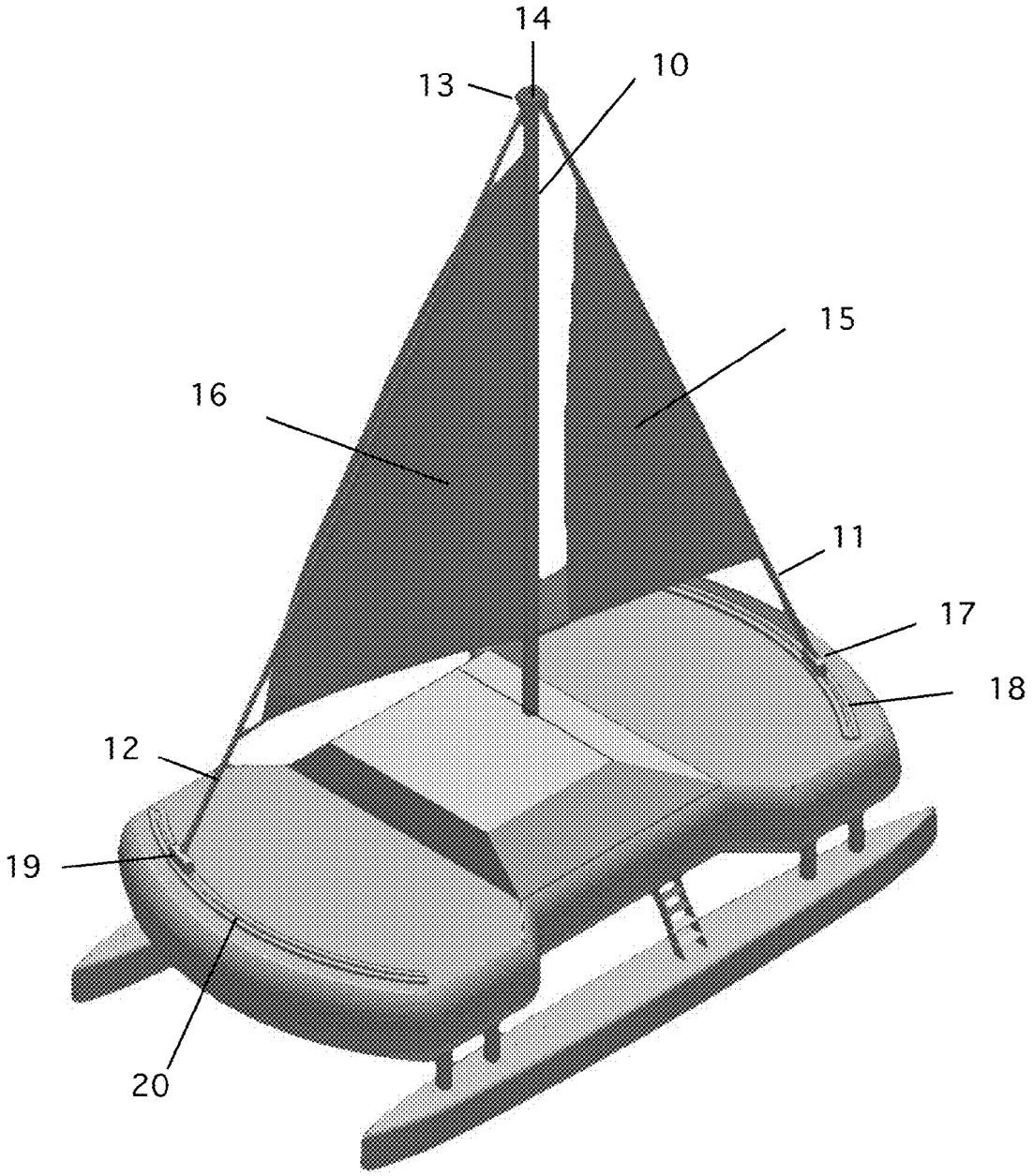
Figure 8:
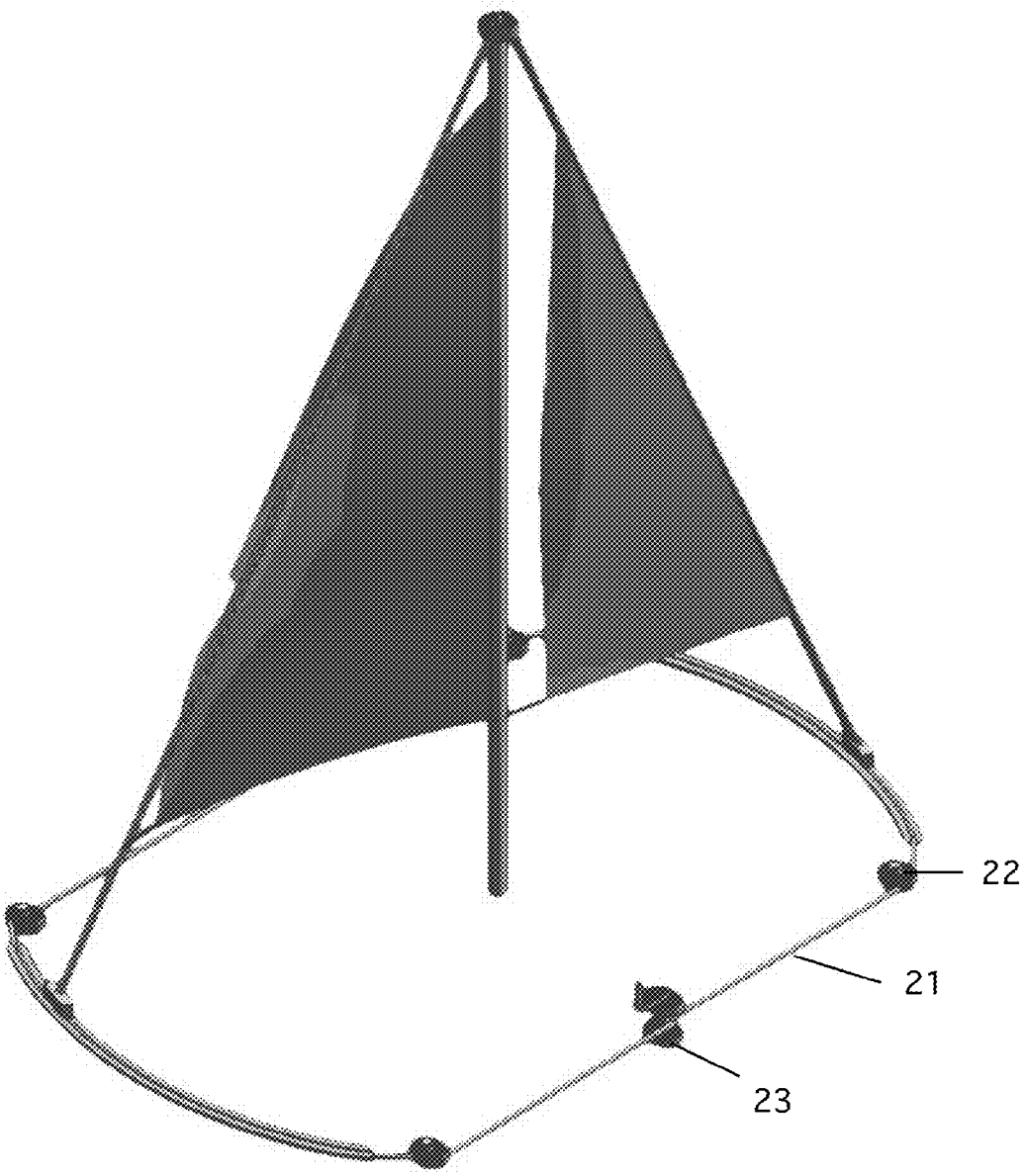
Figure 9:
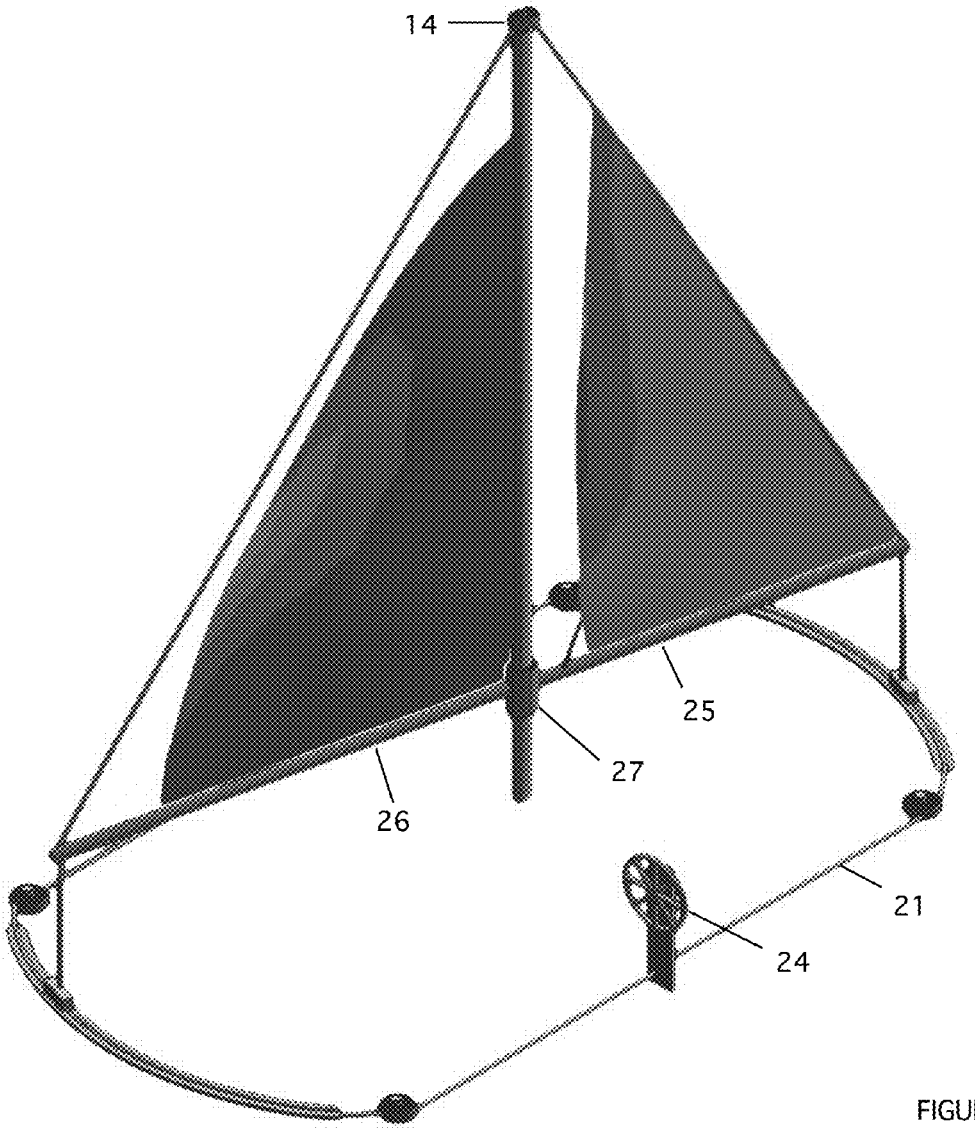
Figure 10:
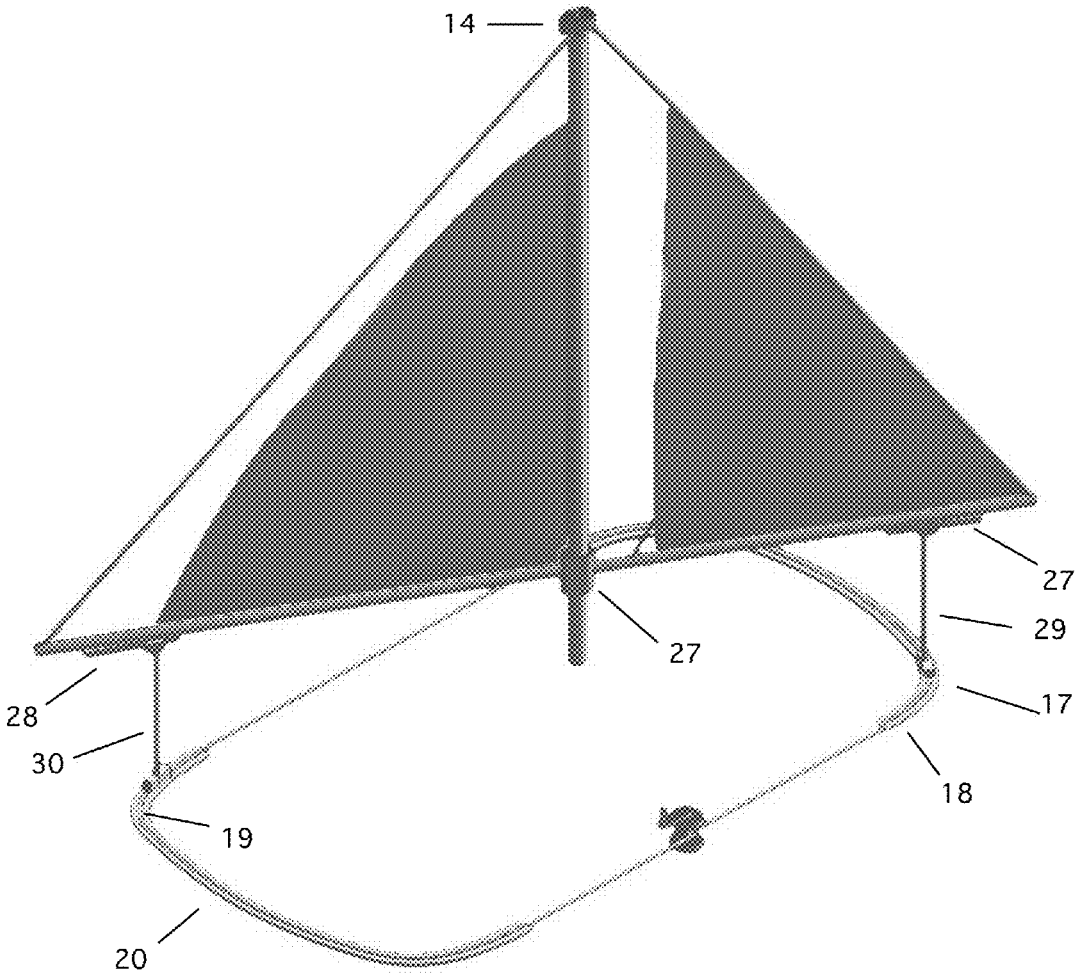
Figure 11:
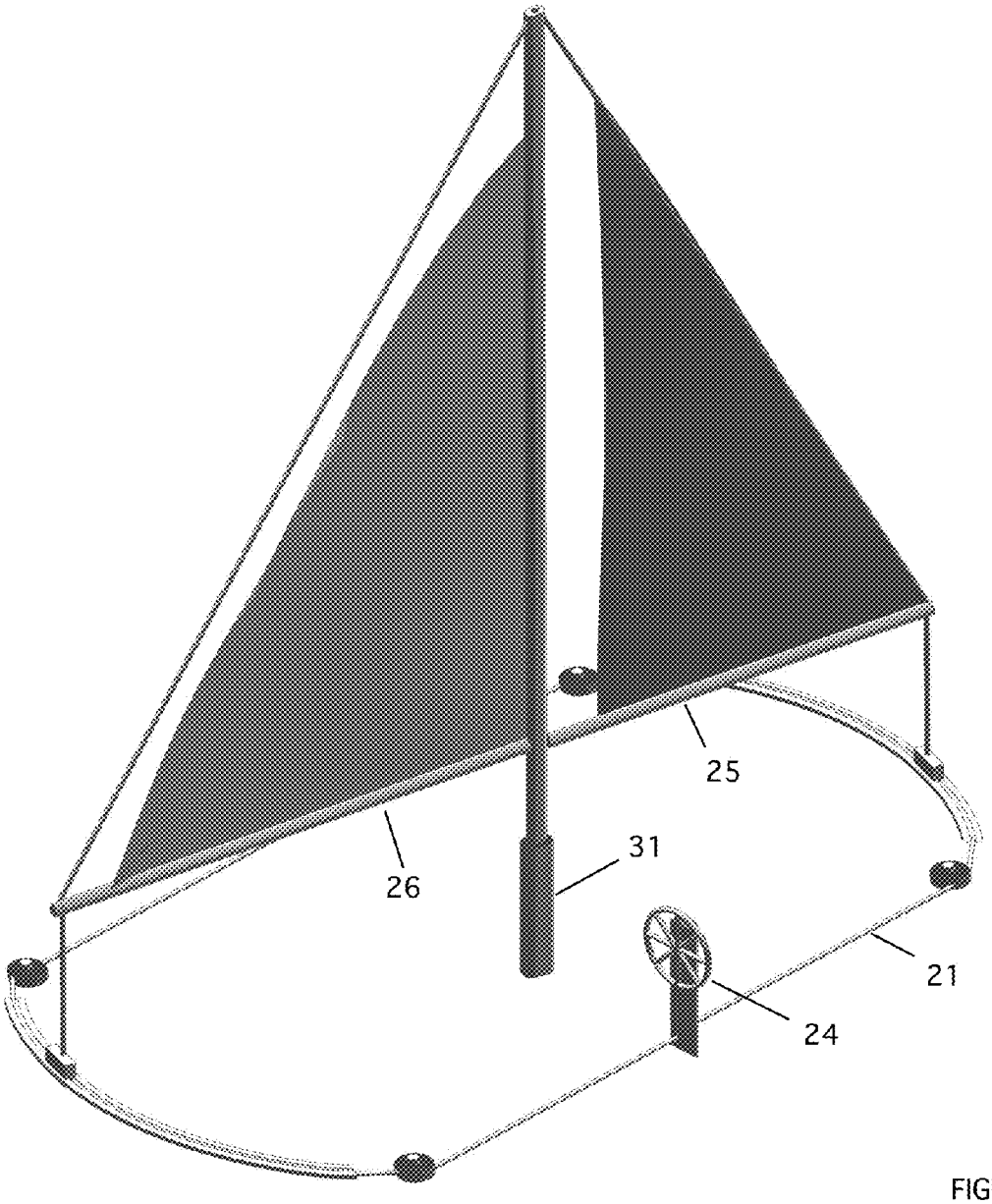
Figure 12:
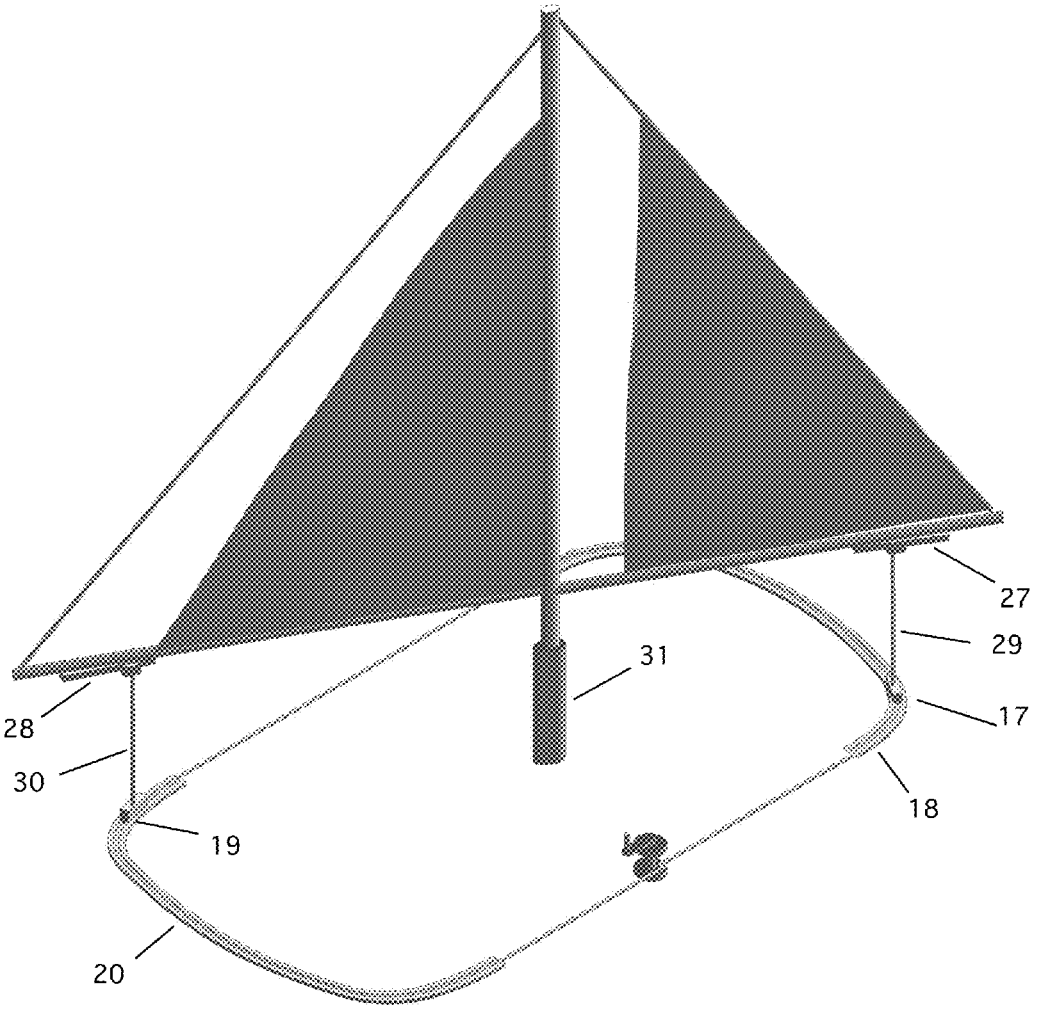

FIG. 6 shows an alternate embodiment where the dinghy 14 is lowered directly into the water via a lowering mechanism 13, where it may be boarded via the inboard edge of the adjacent float hull deck 6. The lowering mechanism 13 in either embodiment is rope or synthetic line attached to a conventional manual winch, electric winch, or equivalent means such as a hydraulic piston.

CONCLUSION

The patent discloses a multihull watercraft with a unique hull configuration providing numerous benefits, including an improved means for dinghy storage and deployment. The scope of the present invention is not limited to the examples provided in the specification, but is defined by the claims.

The invention claimed is:

1. A multihull watercraft comprising:

an upper hull;

left and right float hulls; and four support structures supporting said upper hull above said left and right float hulls;

wherein the left and right float hulls have fore and aft ends, and a lower deck space located above each of said left and right float hulls, and wherein said upper hull bridges the space between said left and right float hulls and comprises a mid-hull portion disposed between forward and aft hull portions, wherein the forward and aft hull portions of the upper hull extend laterally to positions beyond longitudinal centerlines of said left and right float hulls thereby maximizing passenger accommodation space, and wherein the mid-hull portion of the upper hull is positioned intermediate to the fore and aft ends of said float hulls and confined laterally to a region inboard of the longitudinal centerlines of said left and right float hulls, thereby facilitating safer and easier boarding of the upper hull and shore craft from the lower deck space of said left and right float hulls, and facilitating recreational activity closer to the water.

2. The multihull watercraft of claim 1 wherein each of the four support structures is comprised of two or more narrow beams that allow lateral flow of air thereby reducing windage on the watercraft.

3. The multihull watercraft of claim 2 wherein each of said narrow beams is a hollow tube made of metal or composite fiber material.

4. The multihull watercraft of claim 1 further comprising a dinghy storage compartment on an underside of the upper hull for storing a dinghy, a compartment door that covers the dinghy storage compartment, and means to lower the compartment door and the dinghy to a position adjacent one of the float hulls so that the dinghy may be moved out of the storage compartment, across the lower deck space of any one the float hulls, and into the water along an outboard edge of the respective float hull.

5. The multihull watercraft of claim 1 further comprising a dinghy storage compartment on an underside of the upper hull for storing a dinghy and including means to lower the dinghy directly beneath the upper hull into the water at a location inboard of the float hulls where the dinghy can be easily and safely boarded.

* * * * *